United States Patent [19]

Lunsford et al.

[11] 3,976,426

[45] Aug. 24, 1976

[54] METHOD OF DYEING YARN

[76] Inventors: Leslie E. Lunsford, P.O. Box 1483, Dalton, Ga. 30720; Clyde A. Simmons, Rte. No. 5, Calhoun, Ga. 30701

[22] Filed: Aug. 22, 1974

[21] Appl. No.: 499,787

Related U.S. Application Data

[62] Division of Ser. No. 387,493, Aug. 10, 1973.

[52] U.S. Cl. ..... 8/149; 8/155.1; 68/189; 68/107

[51] Int. Cl.[2] ..... D06B 5/16; D06B 21/02

[58] Field of Search ..... 8/149, 155.1, 154; 68/189, 207, 15

[56] References Cited

UNITED STATES PATENTS 3,459,012 8/1969 Renaud et al. ..... 68/89

*Primary Examiner*—Houston S. Bell, Jr.

[57] ABSTRACT

Yarn is wound back and forth around a given axis to form a tightly wound package, whereupon dye is fed into the bottom of the package, with the axis thereof vertically arranged, and forced to flow radially outwardly through the bottom turns of the package to take up the dye and color at least the lower end of the package. Alternatively, water will first be similarly fed through the package adjacent the bottom thereof, the wicking action of the yarn carrying the water to a level above the top level to which dye is then fed through the yarn in the manner stated. The wicking action of the water prevents the application of the dye from extending above the top level at which the dye is supplied to the package, thus giving a sharp color cut off, whereas with the unwatered package, the application of the dye is such that the wicking action carries the dye to a higher point, the intensity of the color progressively diminishing upwardly. A sharp cut off is sometimes preferred, for example in the making of multi-color shag rugs. Assuming that the package has been dyed with one color, for example, red, the package is then removed and inverted for the application of a different colored dye, for example, blue. The intermediate portion of the package, not subjected to the dye action, will remain white. When the package is unwound, dried, and spooled ready for a subsequent operation, for example rug making, the yarn will have successive stretches of the three colors referred to, which show up very attractively in a shag rug.

9 Claims, 7 Drawing Figures

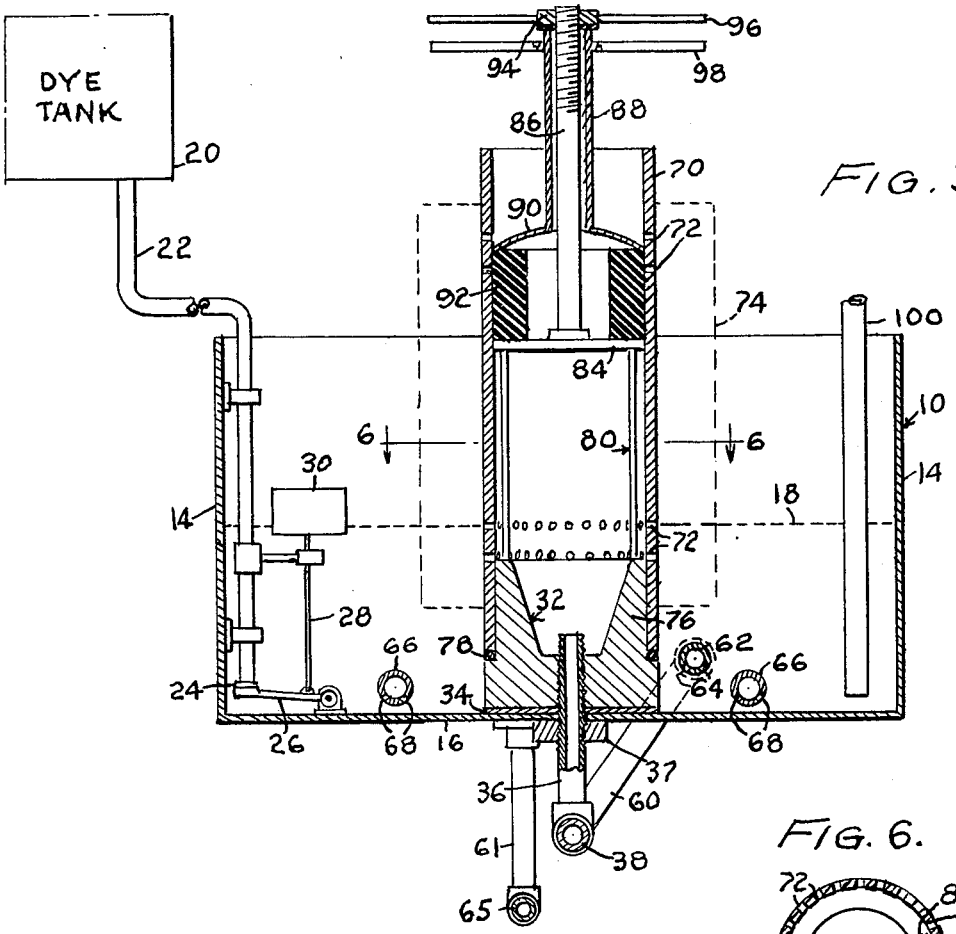
FIG. 3.
FIG. 6.
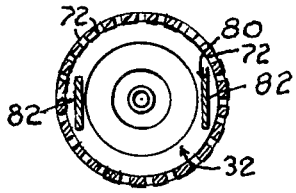
FIG. 4.
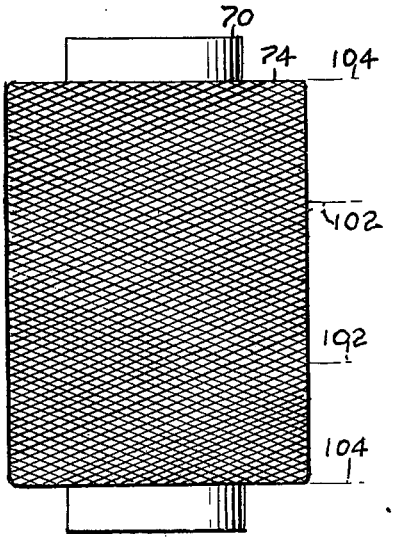
FIG. 5
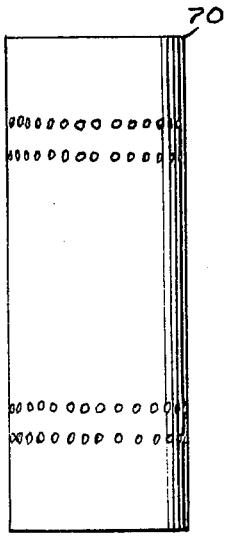
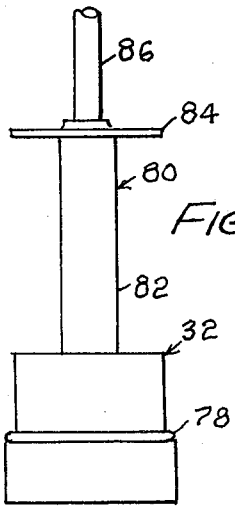
FIG. 7.

METHOD OF DYEING YARN

This application is a division of our co-pending application Ser. No. 387,493, filed Aug. 10, 1973.

As to the apparatus used in the practice of the method, as disclosed in our copending application referred to, a tube, usually having perforations annularly arranged at opposite ends will be wound with the yarn to the desired depth. The tube is then placed vertically over an adapter carried by the bottom of the dye pan, and through the bottom of which dye is supplied through a pipe while a body of the dye is maintained in the pan. The interior of the tube is sealed above the lower tube perforations to prevent the dye from rising to the upper perforations. Dye is then pumped upwardly through the adapters into the tube under pressure and is thus forced to travel radially outwardly through the lower perforations and through the yarn to dye the lower end of the package. The dye is then changed to another color and the perforated tube and package are inverted and placed over the adapter so that the then lower end of the package can be dyed a different color, usually but not necessarily leaving the central portion of the package white.

BRIEF DESCRIPTION OF THE INVENTION

A dye pan is provided in the bottom thereof preferably with a plurality of adapters, each of which is adapted to support the lower end of a rigid tube having preferably two rows of small annularly arranged perforations near the bottom thereof and a similar arrangement of perforations near the top of the tube. In the practice of the method, the tube acts as a support for the winding thereon of the yarn to be dyed. The tube is vertically arranged and the yarn is wound thereon back and forth vertically along the tube to a substantial depth, the winding taking place preferably at a relatively high pitch. As will become apparent, the high pitched winding of the yarn results in a finished dyed yarn in which there are relatively short stretches of color. If the yarn were wound at a relatively low pitch, the dye stretches would be relatively long. A suitable dye is then forced upwardly within the bottom of the wound yarn and radially outwardly to dye the lower end of the yarn.

Alternatively, the initial operation involves the forcing of water through the lower end of the wound package of yarn. The wicking action of the yarn causes the latter to become soaked and accordingly non-absorbent to a point above the level to which dye is supplied as a second step. Dye will accordingly flow radially outwardly through the yarn package and dye will be deposited in the yarn only up to the level at which it is supplied directly to the yarn. The previous absorption of water by the yarn will prevent any wicking action of the yarn to carry the dye above its intended level. This provides a sharp cut off of the dye level in the yarn. If the step of using water is not employed, a wicking action of the dye is present, and some of the dye will be carried upwardly and taper off in color to provide a tone-on-tone effect in the finished product. The dye is preferably water soluble. The dye is preferably recirculated after passing through the lower portion of the yarn package until all the dye is taken up by the yarn and the liquor becomes relatively clear.

The yarn package preferably is then inverted and dye fed outwardly through the lower end of the package, which had been previously arranged at the upper end of the package and free from the dye operation previously described. A dye of a different color is employed in the same manner as before for dyeing what is now the lower end of the package, and this dye may be applied either to dry yarn or to the lower end of the package through which water has been previously applied as described above to effect a relatively sharp cut-off of the color.

Either of the foregoing operations will be enhanced and result in the reduction in the time required for the dyeing operation by immersing the lower end of the package in a body of the dye, preferably up to the same level to which the dye is applied to the interior of the package.

BRIEF DESCRIPTION OF THE DRAWINGS

FIG. 3 is a section on line 3—3 of FIG. 1, parts being shown in elevation, FIG. 4 is a side elevation of the perforated tube with the yarn package wound thereon, FIG. 5 is a side elevation of the perforated tube, FIG. 6 is a horizontal section on line 6—6 of FIG. 3, and FIG. 7 is a side elevation of one of the adapters and associated elements.

DETAILED DESCRIPTION OF THE PREFERRED APPARATUS FOR USE IN PRACTICING THE INVENTION

Figure 1:
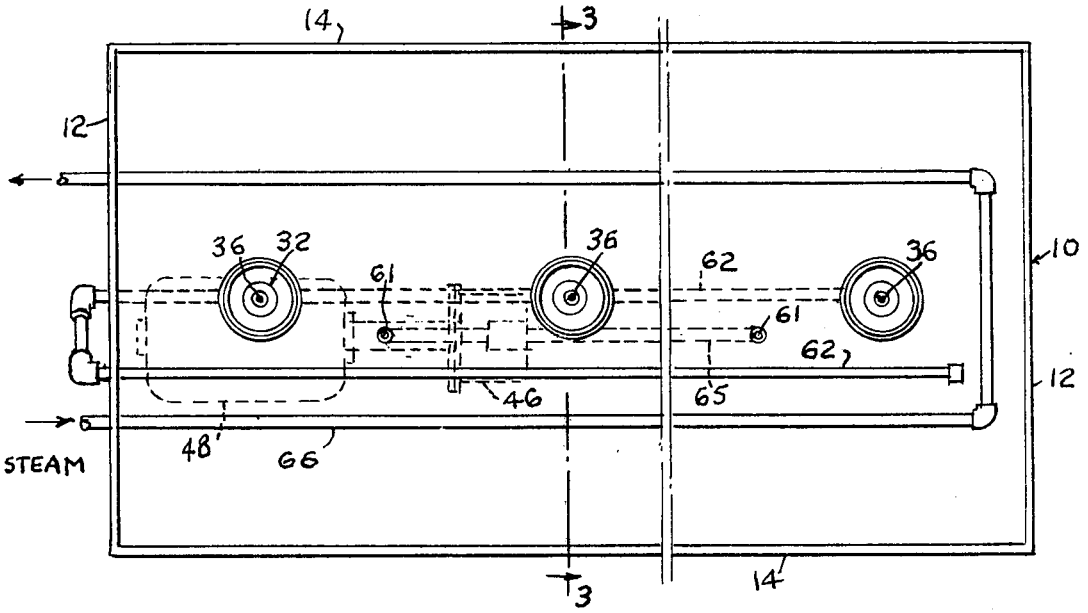
FIG. 1 is a plan view of the pan and associated elements, a portion of the pan being broken away.
Figure 2:
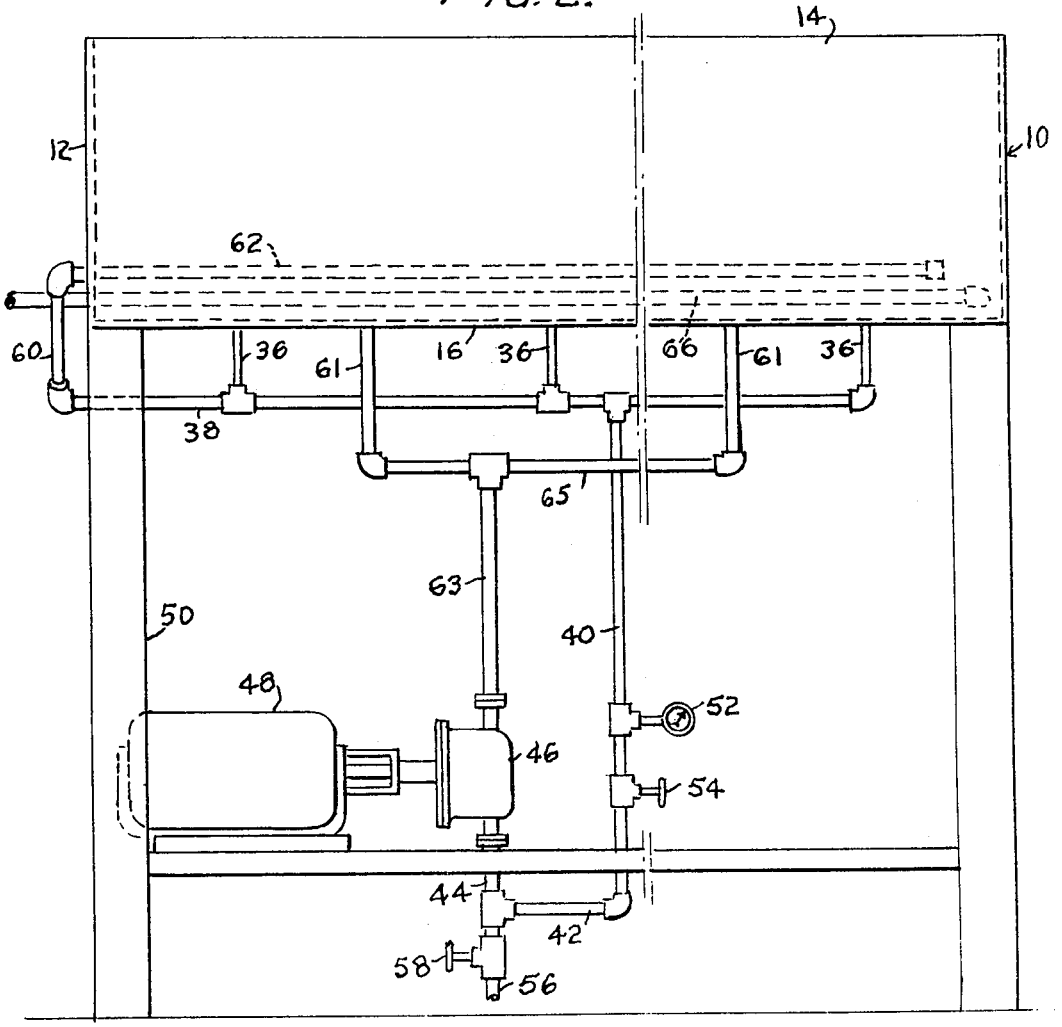
FIG. 2 is a front elevation of the same, parts being broken away.

Referring to FIGS. 1, 2 and 3, numeral 10 designates as a whole, a dye pan having vertical end walls 12 and front and rear walls 14 and a bottom wall 16. During the dyeing operation to be described, the dye will be maintained approximately at the level indicated by the numeral 18. This dye will be supplied from any form of tank 20 in which the dye is maintained heated. The dye is supplied from the tank to the pan adjacent to the bottom thereof through a pipe 22, the lower end of which is controlled by a valve 24 connected to a pivoted arm 26 which is connected by a rod 28 to a float 30. Any type of supply means may be employed for maintaining the level of the dye in the pan.

In the bottom of the pan is arranged a plurality of adapters, each indicated as a whole, by the numeral 32. Each adapter is provided with a washer 34 between it and the bottom 16 of the dye pan. A threaded pipe 36 extends upwardly through each adapter axially thereof and the pipe and adapter are clamped tightly in position by a nut 37. Any number of adapters and pipes 36 may be employed.

Each pipe 36 is connected to a manifold pipe 38 which in turn is connected to a supply line 40 tapped through a pipe 42 into a supply line 44 leading from the outlet side of a pump 46 driven by a motor 48. This motor is suitably supported by a table structure 50 on which the dye pan 10 rests.

The supply line 40 is provided with a pressure gauge 52 and with a cut off valve 54 as shown, and the lines may be drained through a pipe 56 controlled by a valve 58.

The manifold pipe 38 extends beyond one end of the pan 10 then upwardly as at 60 (FIG. 2) for connection with a horizontal pipe 62 which extends throughout the length of the dye pan near the bottom thereof. This pipe is provided with small perforations 64 to agitate liquid in the bottom of the pan to maintain a uniform mixture of the dye. The pipe 62 is arranged near the bottom of the pan with the perforations 64 downwardly angled to prevent surface agitation of the dye.

The pan 10 is provided with outlet pipes 61 connected to opposite ends of a pipe 65, connected intermediate its ends to a return pipe 63 leading to the intake side of the pump 46.

A steam pipe 66 is arranged in the pan adjacent the bottom thereof and is provided with small perforations 68. Live steam is supplied through the pipe 66 to maintain the dye at the proper elevated temperature.

A yarn supporting tube 70 is provided for each of the adapters 32. Each tube 70 is preferably provided adjacent each end with circumferentially arranged small radial openings 72 for the passage therethrough of dye in the manner to be described. Each tube is wound to provide a yarn package 74. This package is formed by winding yarn around each tube 70 constantly back and forth end to end as suggested by the criss-cross lines in FIG. 4. The lower end of each tube fits around an upstanding flange 76 formed on the associated adapter 32, the lower extremity of the tube resting on an 0-ring 78.

A support 80 is carried by the upper extremity of the flange 76 of each adapter. This support comprises diametrically opposite upstanding arms 82 provided at their upper ends with a disc 84 affixed thereto, and the center of the disc is fixed to the lower end of a threaded stem 86 (FIG. 3). A tube 88 is slidable on the upper end of the stem 86 and carries a dished disc 90 at its lower end adapted to seat on the upper end of a tubular seal or bushing 92 resting on the disc 84. On the upper end of the stem 86 is threaded a nut 94 operable by handles 96 to turn the nut 94 downwardly on the stem 86 to deform the bushing 92 into tight engagement with the disc 84 and with the interior of the tube 70. Rotation of the sleeve 88 may be prevented by holding handles 98.

As will be described below, the first operation in the use of the apparatus usually will be to pass water through the perforations 72 and through the lower end of the package, and to this end a suitable water pipe 100 extends downwardly into the pan 10 to supply water thereto, the lower ends of the pipes 22 and 100 terminating near the bottom of the pan to discharge dye or water into the pan without substantial agitation.

OPERATION

In one practice of the method, water will be fed to the pan 10 and the pump 48 will be operated to pump water through pipes 40, 38 and 36. Referring to FIG. 3, this water will flow upwardly through each adapter 32 and thence radially outwardly through the lower perforations 72 and through the lower portion of the yarn package 74, shown in dotted lines FIG. 3. The water will be carried by the wicking action of the yarn upwardly to a point above the level of the water in the pan. The water is then drained from the pan and hot dye introduced thereinto from the tank 20 through the pipe 22. The pump is again operated to force dye radially outwardly through the two lower rows of perforations 72. Due to the previous water soaking of the lower portion of the yarn package, there will be no wicking action to carry the dye upwardly beyond the dye level 18, the dye soaking through all of the lower portion only of the package and cutting off sharply at the line 102 in FIG. 4. Assuming that red dye is being used, the lower portion of the package from the line 102 to the line 104 in FIG. 4, will be dyed. This operation is continued with all of the pigment in the dye being taken up to color the lower end of the package, and when the pigment has been exhuasted and the liquor becomes fairly clear, the dyeing operation is completed. The dyeing operation takes place preferably with the tube 70 arranged with its lower end immersed in dye to the level of the top of the area being dyed.

Assuming that a sharp color cut off at the line 102 is not desired, as is true in some cases, the dyeing operation is carried on without the previous water-soaking of the lower portion of the package. In such case, the color will extend above the line 102 and gradually taper off thereabove, thus providing what may be considered a tone-on-tone dyeing of the lower end of the package.

The dyeing operation being thus completed for the bottom of the package, the pan may be emptied. Each perforated tube 70 will then be removed from the pan and from the associated adapter 32, leaving the adapter and the support bracket 80 in position in the pan. The unscrewing of the nut 94 will relieve pressure on the bushing 92. The sleeve 88, dished disc 90, and bushing 92 are then removed, whereupon the perforated tube 70 with the yarn package 74 still in position thereon, is inverted. The end of the tube 70 is then placed in position on the adapter and the bushing 92 inserted in the then upper end of the tube 70. The sleeve 88 is replaced and the nut 94 reapplied and turned to deform the bushing 92 to seal the upper end of the tube to prevent dye from the succeeding operation from reaching the perforations 72 within the previously dyed end of the package. The operation is then repeated to dye the lower end of the package a different color, for example, blue.

In winding the yarn on the tube 70, the winding operation takes place at a fairly sharp angle successively upwardly and downwardly along the tube 70. When the dyeing operation is completed, therefore, the strand of yarn will have successive sections thereof provided with relatively sharp cut offs of the applied color, except where water is not first used. In the latter case, there will be uniform sections of color which will taper off and lighten into white and then pick up the color applied to the opposite end of the package.

The yarn unwound from the package will be subjected to the action of conventional equipment to remove excess moisture from the yarn, whereupon the yarn is suitable for further processing.

When clear water is first used to utilize the wicking action of the yarn to provide a sharp cut off of color at the line 102, the water will be fed through the perforations 72, preferably at 50% more pressure than will be used to circulate the dye liquor that is introduced as the later step. As stated, this provides sharper and better controlled color bands when the dye liquor is introduced.

When the dry yarn package placed on each adapter is subjected immediately to the dye liquor, the natural wicking migration with the dye creates additional band areas of a subtle lighter color beyond the dark fully dyed section. This is considered very desirable in carpet styling. Striking and beautiful effects are provided in finished products, notably shag rugs. The method, therefore, comprises supporting a package of yarn wound back and forth from end to end, and forcing dye radially outwardly through at least one limited area of the package to absorb the dye and color such area so that when the package is unwound, dyed sections will show up in spaced relation along the yarn. The method further contemplates first supplying water to a limited area of the yarn, by forcing the water radially outwardly through the yarn package so that the wicking action carries along the package upwardly beyond the area to be dyed, then subjecting said area of the package to the dyeing action, the wetting of the yarn beyond such area limiting the absorption of dye to the desired area. This provides a sharp cut off of the colored area so that when the yarn is unwound, each colored section will pass abruptly into an uncolored section without the tapering off of the color.

The dye in the tank 20 will remain preferably at a temperature of about 212°F. The admission of live steam through the pipe 66 into the pan maintains the temperature of the dye and the limited escape of steam through the perforations 68 not only helps to maintain the temperature level, but assists in keeping the dye stirred without substantial agitation. The slight diluting of the dye by the escaping steam is unimportant, the steam escaping into the dye liquor immediately condensing without substantial dilution of the dye. The pumping of the dye through pipe 62 also assists in the stirring action to maintain the dye liquor uniform, the dye escaping preferably downwardly at an angle through openings 64 (FIG. 3). It will be noted that the stirring action takes place near the bottom of the pan. This is highly desirable since the surface of the dye liquor should remain quiescent without the formation of waves which would cause the dye in the pan to rise higher along the package.

We claim:

1. The method of packaging and dyeing yarn which comprises forming a yarn package by winding the yarn back and forth spirally around a vertical axis, and forcing dye radially outwardly solely through the lower portion of the package to dye a limited portion of the lower end of the package.

2. The method defined in claim 1 wherein clear water is forced through the lower end portion of the package at least to a level corresponding to the level at which the dye is forced radially outwardly through the package prior to such dyeing operation.

3. The method of packaging and dyeing yarn which comprises supporting solely interiorly thereof a yarn package wound back and forth from end to end of the package, positioning the package vertically, and forcing dye radially outwardly solely through the lower end portion of said package to dye a limited portion of the lower end of the package.

4. The method defined in claim 3 wherein clear water is forced through said lower end portion of the package prior to the forcing of the dye therethrough to utilize the wicking action of the yarn in the package to prevent the absorption of the dye by the yarn except in that portion of the length of the package which it is desired to dye, so that when the yarn is unwound, there will be a sharp cut off of color at the ends of the portions of the yarn which have been dyed.

5. The method defined in claim 3 followed by the additional steps of inverting the yarn package, and forcing dye radially outwardly through a different section of the length of the package from the section of the package previously dyed.

6. The method defined in claim 5 wherein the dyeing of said different section of the package is preceded by the forcing of water radially outwardly through said different section of the package to utilize the wicking action of the yarn to limit the length of said different section of the package which will absorb dye.

7. The method defined in claim 3 wherein said lower end portion of said package is immersed in a body of the dye during the forcing of the dye through said lower end portion of said package.

8. The method defined in claim 4 wherein said lower end portion of said package is immersed in a body of the dye during the forcing of the dye through said lower end portion of said package.

9. The method defined in claim 3 wherein said lower end portion of said package is immersed in a body of the dye during the forcing of the dye through the lower end portion of said package, and wherein clear water is forced through said lower end portion of the package prior to the forcing of the dye therethrough.

* * * * *